US009078536B2

(12) United States Patent
Boettcher

(10) Patent No.: US 9,078,536 B2
(45) Date of Patent: Jul. 14, 2015

(54) MONUMENT ASSEMBLY

(76) Inventor: James Boettcher, Storm Lake, IA (US)

( * ) Notice: Subject to any disclaimer, the term of this patent is extended or adjusted under 35 U.S.C. 154(b) by 487 days.

(21) Appl. No.: 11/695,414

(22) Filed: Apr. 2, 2007

(65) Prior Publication Data

US 2008/0239714 A1 Oct. 2, 2008

(51) Int. Cl.
*F21L 4/00* (2006.01)
*A47G 29/122* (2006.01)

(52) U.S. Cl.
CPC ..... *A47G 29/122* (2013.01)

(58) Field of Classification Search
USPC ..... 362/192, 151, 152, 153, 183; 40/359–362
See application file for complete search history.

(56) References Cited

U.S. PATENT DOCUMENTS 5,255,170 A * 10/1993 Plamp et al. ..... 362/183
5,564,816 A 10/1996 Arcadia et al.
6,132,054 A * 10/2000 Rogers et al. ..... 362/86
6,240,665 B1 * 6/2001 Brown et al. ..... 40/570
7,125,138 B2 10/2006 Reinmann

FOREIGN PATENT DOCUMENTS

CA 2300481 C * 12/2003
GB 2423350 A * 8/2006

* cited by examiner

*Primary Examiner* — Sandra L O'Shea
*Assistant Examiner* — Danielle Allen
(74) *Attorney, Agent, or Firm* — Zarley Law Firm, P.L.C.

(57) ABSTRACT

A monument assembly having a main body that is interlocked with a base. The main body has inscriptions and etchings that are laser cut therein of a memorable photo or design. A plurality of solar powered lights are then used in association with the monument assembly to focus light onto the etching at night to illuminate the etching.

19 Claims, 3 Drawing Sheets

MONUMENT ASSEMBLY

BACKGROUND OF THE INVENTION

This invention relates to lighting assemblies. More specifically, this invention relates to a monument lighting assembly that uses a plurality of lights to accentuate etchings thereon.

When a loved one passes away often time monuments or head stones are provided with special inscriptions thereon to commemorate the individual. Previously, individuals have used lighting systems including systems that use solar power in order to provide a light source for the monument such that the monument may be seen at night.

While improvements in the field have been made, additional problems still remain. Specifically, with the advancement of technology and the creation of etchings on monuments a need for more accurately placed lighting is desired. Additionally, a need to provide replaceable and/or interchangeable etchings, batteries and the like is also desired.

Therefore, a principal object of the present invention is to provide a lighting assembly that provides night time lighting to provide a more esthetically pleasing monument.

Yet another object of the present invention is to provide a lighting assembly that provides for the illumination of etchings disposed thereon.

These and other advantages and features will become apparent from the specification and claims.

BRIEF SUMMARY OF THE INVENTION

A lighting assembly comprising a monument main body having an inscription and an etching therein. The monument main body is interlocked to a base wherein a rechargeable battery is associated with the monument assembly. A plurality of lights are electrically connected to the battery and are positioned to light the etching on the monument.

DETAILED DESCRIPTION OF THE PREFERRED EMBODIMENT

Figure 1:
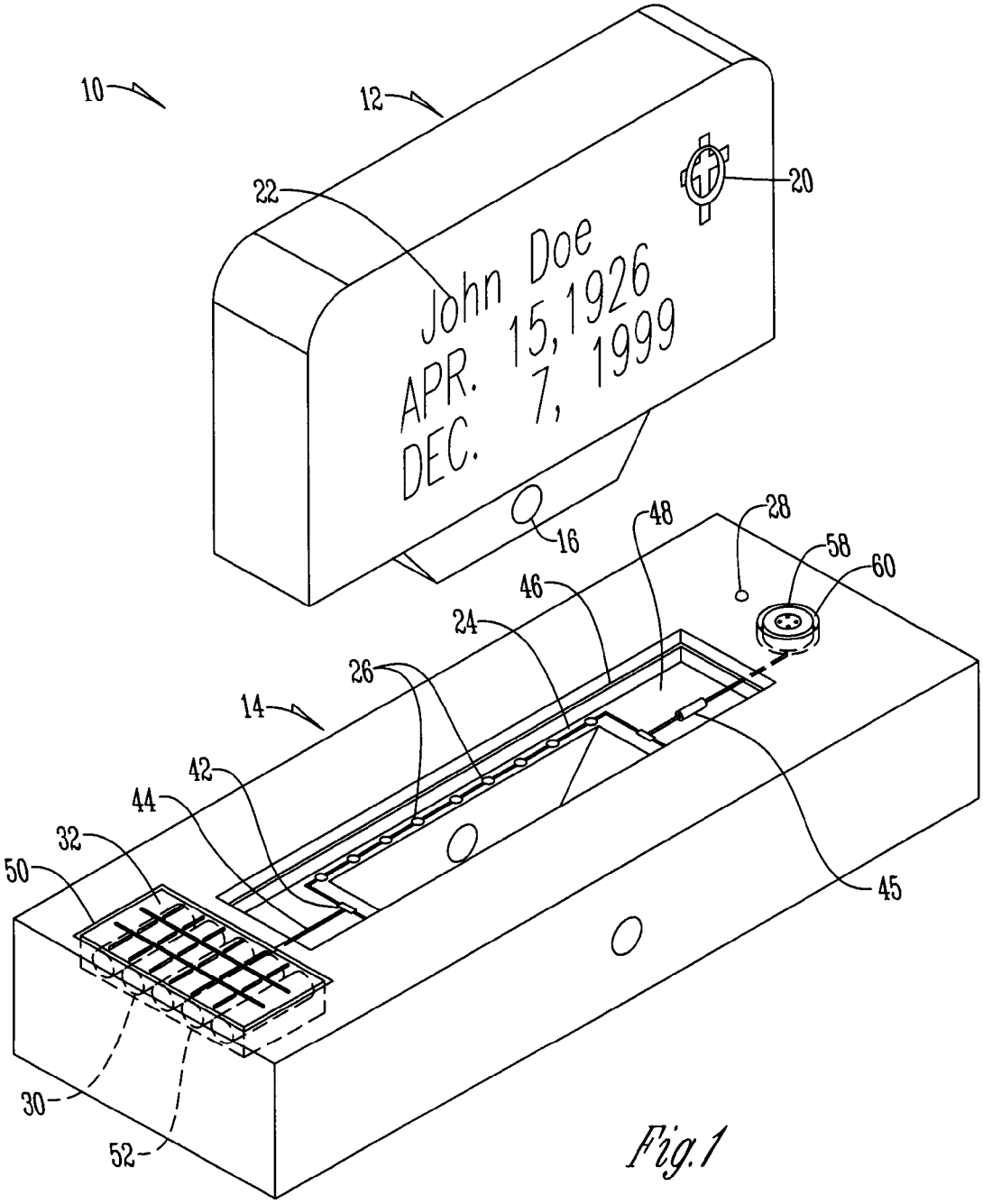
FIG. 1 is an exploded side plan view of a monument lighting assembly.

FIG. 1 shows a monument lighting assembly 10 comprising a main body 12 that interlocks with a base 14. In a preferred embodiment the main body and base 12, 14 are interconnected using a retainer opening 16 of the main body 12 that aligns with an opening in the base 14 such that a pin 18 can be disposed therethrough to detachably secure the main body 12 to the base 14. This configuration allows for easy access to the main body 12 detachable from the base 14. The main body 12 is made of glass, hard acrylic, hard Plexiglas, or the like and can come in any size and shape. Similarly, the base 14 can be made of ceramics, harden plastics, stone, or the like.

The main body 12 of the monument assembly 10 can have 2D or 3D etchings 20, such as etched photos inlayed in the main body 12. The etching 20 can be of a loved one from a photo chosen by the person buying the monument. Any photo can be used such as a family photo, favorite hobby, a memory photo wanted by the family to be represented in the monument or the like. Additionally, the etching 20 may be placed anywhere on the main body 12 such as centered, in the corners, or anywhere that a laser etching may be placed. Additionally, an inscription 22 is also placed in the main body 12. Specifically, the name, birth and death dates can be carved, drilled or the like into the main body 12 of the monument lighting assembly 10.

The base 14 contains ledges 24 that house a plurality of lights 26. The ledges 24 are contained on both sides of the monument main body 12. Optionally, color strips can be applied on the plurality of lights 26 to provide ambience lighting such as blue, green, yellow, pink, red or the like in order to illuminate the monument. Additionally, in a preferred embodiment LEDs (light emitting diodes) are used as the plurality of lights 26. The inscription 22 may then be frosted by a bead blaster to make the inscription 22 to appear opaque so that the inscription stands out both during the day time and in the evening when the plurality of lights 26 illuminates the main body 12 of the monument.

Electrically connected to the plurality of lights 26 and disposed within the base 14 is a light sensor 28 that contains a timer therein. The light sensor 28 detects light and if light is detected for a predetermined amount of time, the timer causes the plurality of lights 26 to become inoperable. Thus, during the day time when light is provided for viewing of the monument assembly 10 the plurality of lights 26 do not operate needlessly.

Electrically connected to the light sensor 28 is a battery pack 30 disposed within the base 14. The battery pack 30 comprises a rechargeable battery that provides electricity for the plurality of lights 26. A solar collector panel 32 is additionally disposed within the base 14 and is electrically connected to the battery pack 30 in order to convert light into electrical energy to charge the battery pack 30. Thus, the plurality of lights 26 can be constantly powered by the battery pack 30 via the use of the solar collector panel 32.

Wiring connectors 42 are used for separation and replacement ease. Wiring 44 disposed through channeling 45 electrically connects the battery pack 30 and the solar collector panel 32 for night activation wherein the solar connector charges the battery pack 30 during the day light when the battery pack 30 is not in use.

A weather seal 46 is used to prevent water intrusion and is placed in a grooved lip in the base 14 that secures the seal 46 therein. The weather seal surrounds an opening 48 within the base that receives the main body 12 of the monument assembly 10. Additionally, while the base 14 in FIG. 1 is shown with a single solar collector panel 32 a plurality of solar collector panels may be used to recharge the battery. Additionally, a second weather seal 50 may be used around the solar collector panel 32 to prevent the solar collector panel 32 from being exposed to water. The second weather seal 50 is removable for access to the battery pack 30 for battery replacement when necessary. Specifically, in this embodiment the battery pack 30 is contained within a battery compartment 52 that is sealed by the second weather seal 50.

Additionally disposed within the base 14 can be a lighting fixture 58 within a groove 60. In an alternative embodiment the lighting fixture 58 is a replaceable LED that is similar to a slide show projector bulb setup and the groove 60 is made of a specialty bulb casing and design such that a glass urn may be placed into the monument base allowing for ambient lighting. Color covers are optional. This lighting fixture 58 has wiring 44 that connects the fixture 58 to the wiring connector 42 that is used to provide power to the lighting fixture 58. Thus, in this embodiment an urn may be placed into the base 14.

Figure 2:
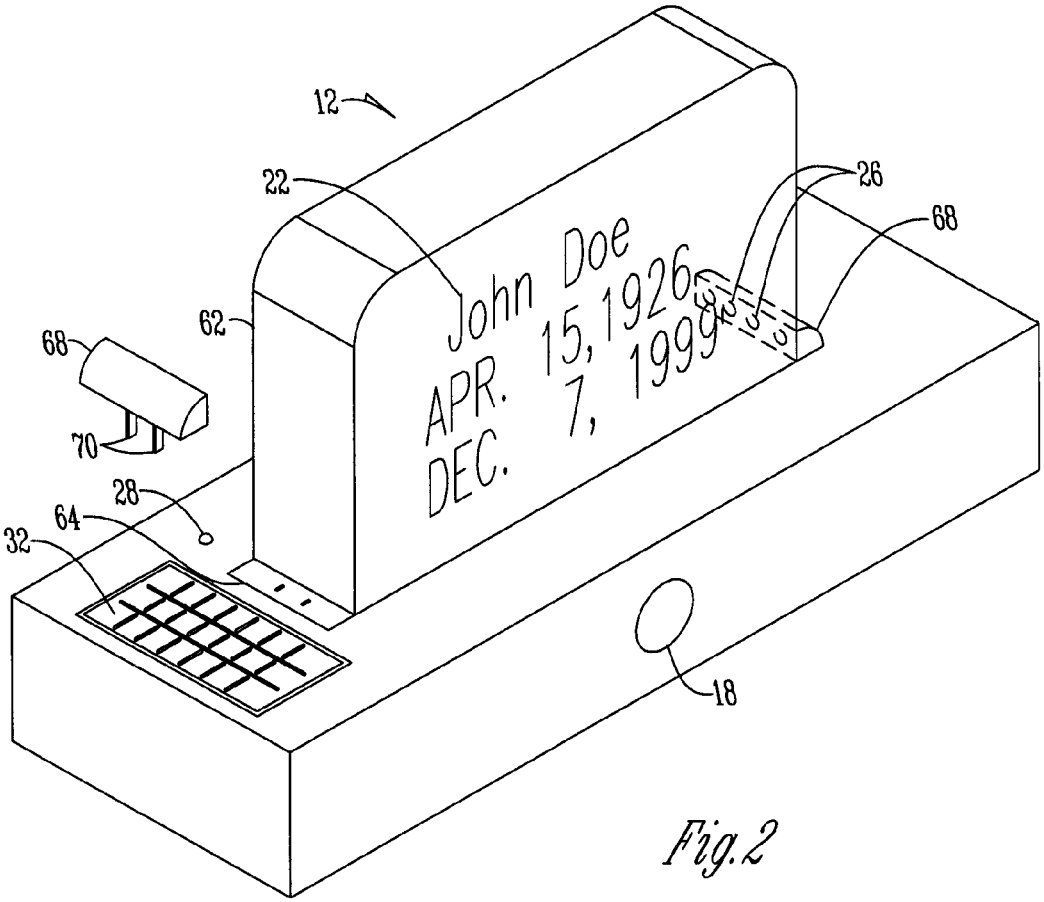
FIG. 2 is an exploded side plan view of a monument lighting assembly.

FIG. 2 shows another embodiment wherein the plurality of lights 26 appear on a side wall 62 of the main body 12.

Specifically, plugs 64 are mounted adjacent the monument opening 48. The plugs 64 receive lighting housings 68 that contain the plurality of lights 26 and has electrical prongs 70 connected thereto for electrical connection to the plugs 64. In a preferred embodiment the plugs 64 are slightly recessed to help secure the lighting housing within the base 14 to prevent easy disconnection of the lighting housing 68 from brushes with a lawnmower, passersby, people tampering with the lighting units and the like. Thus, yet another way of providing lighting to etchings 20 within the main body 12 is provided.

When the main body 12 of the monument assembly 10 is not a traditional rectangular shape but instead a cross or statue, similarly bead blasting can occur to create a similar effect. Specifically, the base 14 for the non traditional monument is similar only with the plurality of lights 26 much closer together gathering lighting making the lighting more condensed consistent with the size of the monument. Similarly, if a monument is larger the plurality of lights 26 is spread out over a larger area.

Figure 3:
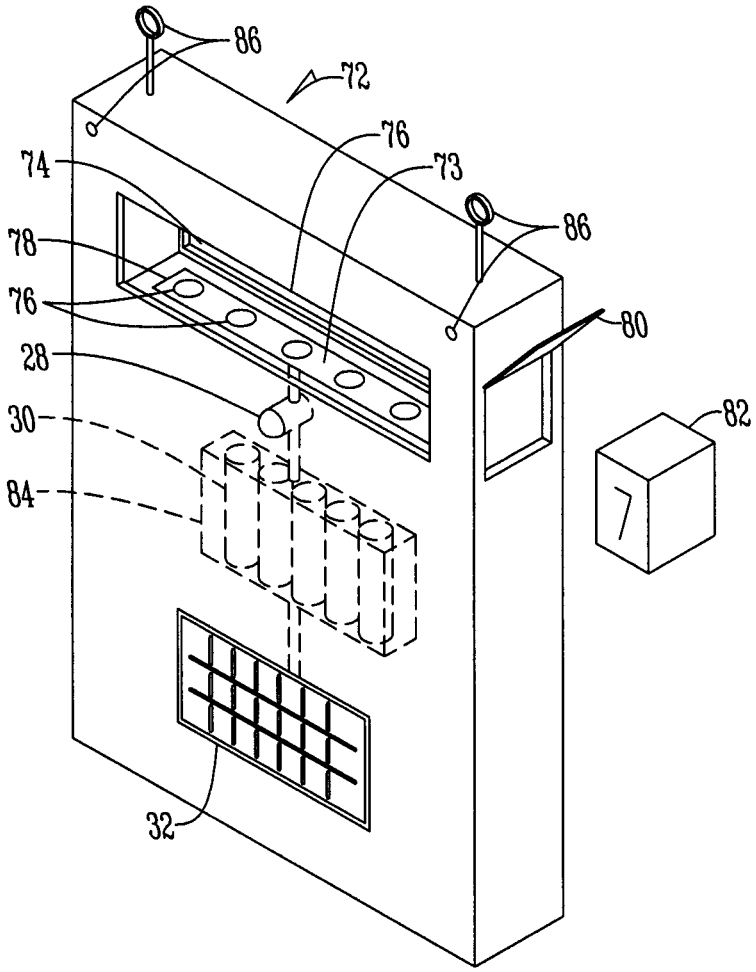
FIG. 3 is a side plan view of a lighting assembly.

FIG. 3 shows an alternative embodiment wherein a lighting assembly 72 is provided. The lighting assembly can be any size or shape. Like the base 14 of monument lighting assembly 10, lighting assembly 72 has a plurality of lights 26, a light sensor 28, battery pack 30 and solar collector panel 32 electrically connected and disposed therein. In a preferred embodiment LED lighting strips 73 are used with one strip on each side of the lighting assembly 10 to allow ease for disconnection and replacement when needed.

Furthermore, the lighting assembly 72 has a compartment 74 disposed therein having a top 76 and a bottom 78. The compartment 74 additionally has a gate 80 secured thereto and removable to allow access to the compartment 74. The bottom 78 of the compartment 74 has a track that receives etched blocks 82 wherein the etched blocks 82 can contain indicia such as letters, numbers, words, pictures or the like. The etched blocks 82 are any size or shape and are designed to a size and shape to fit within compartment 74. Adjacent the bottom 78, or track, are the plurality of lights 26 that in a preferred embodiment are LEDs. Thus, the plurality of lights 26 illuminate the etched blocks 82 contained within the compartment 74.

The lighting assembly 72 also contains a battery pack compartment 84 that houses the battery pack 30. The battery pack compartment 84 is accessible for replacing the battery pack 30 via a detachable cover plate (not shown). The lighting assembly also has hanging members 86 attached thereto or hanging openings 88 therein to allow the lighting fixture to be hung from apparatuses such as mail box poles, houses and the like.

Thus, in this embodiment the lighting assembly 72 can use laser etching to display housing numbers, business numbers, business names or the like using lighting on the replaceable lighting strip 73. Just like the monument lighting assembly 10 the lighting assembly 72 in the evening hours is illuminated by the plurality of lights 26 to facilitate viewing.

Therefore, provided are several embodiments wherein a plurality of lights are used to illuminate an etching on a main body of a lighting assembly. All of the main parts are easily accessible such as by an access cover or the like to create easy replacement of the different parts of the monument assembly 10. Additionally, the pin an opening arrangement between the main body 12 and the base 14 of the monument lighting assembly 10 provide for a detachable main body 12 for when replacement of parts or access to parts in the base 14 is desired. Thus, at the very least all of the stated objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. A lighting assembly comprising:

a monument main body having an inscription and an etching therein;

a base interlocked with the monument main body;

a rechargeable battery associated with the lighting assembly; and a plurality of lights electrically connected to the battery and positioned within the base to light the etching of the monument main body.

2. The lighting assembly of claim 1 where the rechargeable battery is disposed within the base.

3. The lighting assembly of claim 1 wherein the rechargeable battery is disposed with the monument main body.

4. The lighting assembly of claim 1 wherein the plurality of lights are LEDs.

5. The lighting assembly of claim 1 wherein the etching is made with a laser.

6. The lighting assembly of claim 1 wherein the rechargeable battery is charged by a solar cell.

7. The lighting assembly of claim 6 wherein the solar cell is encased by a weather strip seal.

8. The lighting assembly of claim 1 wherein the plurality of lights are on a ledge on the base.

9. The lighting assembly of claim 1 wherein the plurality of lights are covered with a sheet of color coated material.

10. The lighting assembly of claim 1 wherein the base and the monument main body are interlocked with a retainer pin.

11. The lighting assembly of claim 1 further comprising a light sensor electrically connected to the plurality of lights.

12. The lighting assembly of claim 11 wherein the light sensor has a timer that causes the plurality of lights to be inoperable when light is detected by the light sensor for a predetermined amount of time.

13. The lighting assembly of claim 1 wherein the base has a replaceable LED lighting fixture disposed therein.

14. A lighting assembly comprising:

a compartment disposed within the lighting assembly and having a top and a bottom;

at least one block having an etching therein disposed within the compartment;

a rechargeable battery associated with the lighting assembly; and a plurality of lights electrically connected to the battery and positioned to light the etching of a block.

15. The lighting assembly of claim 14 wherein the plurality of lights are adjacent the bottom of the compartment.

16. The lighting assembly of claim 14 wherein the rechargeable battery is in a battery compartment having a replaceable cover to provide access to the rechargeable battery.

17. The lighting assembly of claim 1 wherein the inscription appears opaque.

18. The lighting assembly of claim 1 wherein the plurality of lights are positioned between the main body and the base.

19. The lighting assembly of claim 14 wherein the block is transparent.

* * * * *